US007617635B2

(12) United States Patent
Jacobs et al.

(10) Patent No.: US 7,617,635 B2
(45) Date of Patent: Nov. 17, 2009

(54) MULTI-CONFIGURABLE PLATFORM SEATING SYSTEM

(75) Inventors: Frederick D. Jacobs, Holland, MI (US); Dennis V. Rupar, Spring Lake, MI (US); Joshua A. Bordewyk, Fruitport, MI (US)

(73) Assignee: Track Corp., Spring Lake, MI (US)

( * ) Notice: Subject to any disclaimer, the term of this patent is extended or adjusted under 35 U.S.C. 154(b) by 224 days.

(21) Appl. No.: 11/674,860

(22) Filed: Feb. 14, 2007

(65) Prior Publication Data

US 2008/0190038 A1 Aug. 14, 2008

(51) Int. Cl.
*E04H 3/12* (2006.01)

(52) U.S. Cl. ..... 52/8; 52/9

(58) Field of Classification Search ..... 52/6–10; 248/235, 295.11, 241, 243
See application file for complete search history.

(56) References Cited

U.S. PATENT DOCUMENTS

| | | | | | |
|---|---|---|---|---|---|
| 2,897,013 | A * | 7/1959 | Delp | 52/645 |
| 2,983,968 | A * | 5/1961 | Wurn | 52/9 |
| 4,168,764 | A * | 9/1979 | Walters | 182/1 |
| 4,179,090 | A * | 12/1979 | Williams et al. | 248/235 |
| 4,880,203 | A * | 11/1989 | Holcomb et al. | 249/24 |
| 5,524,854 | A * | 6/1996 | McSwain et al. | 248/354.1 |
| 5,943,830 | A * | 8/1999 | Truitt | 52/127.2 |
| 6,055,780 | A * | 5/2000 | Yamazaki | 52/9 |
| 6,076,306 | A * | 6/2000 | Victor et al. | 52/9 |
| RE37,043 | E * | 2/2001 | Yamazaki | 297/332 |
| 6,185,875 | B1 * | 2/2001 | Victor et al. | 52/9 |
| 6,199,324 | B1 * | 3/2001 | Guiles et al. | 52/9 |
| 6,224,127 | B1 * | 5/2001 | Hodge | 296/26.08 |
| 6,244,657 | B1 * | 6/2001 | Momose | 297/217.7 |
| 6,354,041 | B1 * | 3/2002 | Guiles et al. | 52/9 |
| 6,415,551 | B1 * | 7/2002 | Norman | 52/10 |
| 6,625,932 | B1 * | 9/2003 | Littlefield | 52/10 |
| 6,854,216 | B2 * | 2/2005 | Ahrens et al. | 52/9 |
| 6,925,760 | B2 * | 8/2005 | Suprina | 52/9 |
| 2003/0200703 | A1 * | 10/2003 | Suprina | 52/9 |
| 2004/0182012 | A1 * | 9/2004 | Ahrens et al. | 52/9 |
| 2006/0179728 | A1 * | 8/2006 | Lang | 52/127.2 |
| 2008/0083170 | A1 * | 4/2008 | Staten et al. | 52/10 |
| 2008/0190038 | A1 * | 8/2008 | Jacobs et al. | 52/9 |

* cited by examiner

*Primary Examiner*—Richard E Chilcot, Jr.
*Assistant Examiner*—Andrew J Triggs
(74) *Attorney, Agent, or Firm*—Warner Norcross & Judd LLP

(57) ABSTRACT

A multi-configurable platform seating system with chairs mounted to the nose of each deck where seating is desired. The system includes a structural member disposed at the front of each deck, and each chair is removably secured to the deck by a pair of standards that are removably secured to the structural member. The system may include program supports that mount to the standards to support the forward end of a deck without removing any chairs. The program supports are removably mountable so that they can be installed to support decks at different heights when the system is in different configurations. The system may also include a handrail system that is mounted to the standards. The handrail system is removably mountable so that it can be installed in essentially any desired location as the system is placed in different configurations. The system may also be reconfigurable to convert a section of seating into a team box.

7 Claims, 16 Drawing Sheets

MULTI-CONFIGURABLE PLATFORM SEATING SYSTEM

BACKGROUND OF THE INVENTION

The present invention relates to platform seating systems and more particularly to a multi-configurable platform seating system with chairs.

Platform seating systems are used in a wide variety of venues where the quantity of seats must be varied from application to application. For example, platform seating is common in arenas, stadiums, field houses, gymnasiums, convention centers and other similar facilities. Conventional platform seating systems often incorporate fixed or retractable frameworks, or a combination of fixed and retractable frameworks. Fixed systems are essentially stationary providing a specified number of seats for essentially all events. Retractable systems, on the other hand, are extendable and retractable to provide varied seating as desired. Retractable systems often include a telescoping framework that allows platforms to nest within each other. Retractable systems are ideal where the number of seats or the amount of floor space required may vary from event to event. For example, a venue may retract portions of the seating system to provide additional floor space for a trade show or other event where the seating is not needed. Alternatively, the venue may extend portions of the seating system to provide maximum seating for sporting events, concerts or other events where additional seating is desired. Many venues include a combination of fixed and retractable platform seating systems. It is desirable to have seats with a consistent style and appearance throughout the venue.

Platform seating systems are available in a variety of designs and configurations. The design of the system will often depend on the type of seating to be incorporated into the system. For example, entry level telescopic platform seating systems typically utilize a deck (also known as a "riser") mounted chair. Premium telescopic seating systems typically utilize a nose-mount configuration when individual chair seating is desired. With a nose-mount configuration, the chair for a particular deck is mounted to the nose of the next higher deck with the seat cantilevered over the lower deck. For the uppermost deck, the chairs may be mounted toward the rear of the deck using conventional upright standards, or on a constructed nose, or to the fixed structure directly behind the telescopic platform.

Nose mount telescopic platform systems provide many advantages over entry level deck mounted systems. The seating on each deck of the telescopic platforms is typically the most desirable seating in the arena and commands a premium ticket price because of its location. Nose mount telescopic platform systems provide additional space to allow the seating manufacturer to provide a more comfortable/premium seating construction, and consistent seat type throughout the arena. These advantages may enable the arena owner to increase revenue. Although others have provided nose-mount seating systems in the past, these systems have provided limited flexibility, incurred structural problems and, where reconfiguration is possible, it is relatively complex and labor intensive.

SUMMARY OF THE INVENTION

The aforementioned problems are overcome by the present invention wherein a platform seating system is provided with chairs mounted to the nose of each deck where seating is desired. The system includes a structural member mounted to the front of each deck, and each chair is secured to the deck by a pair of standards. In one embodiment, the structural member is a nose beam that is attached to the deck or the support structure for the platform.

In one embodiment, each standard includes a front portion that extends beyond the front of the deck and a rear portion that extends over the deck. The chair may be mounted to the front portion of the standard so that the seat is suspended in front of the deck. The seat bottom may be foldable to reduce the space occupied by the seat when the chair is not in use. In telescopic platform seating systems, the seat bottom may fold up to a position short of vertical so that the seats of adjacent rows may nest within each other when the seating system is retracted.

In one embodiment, each standard includes a folding bracket that can be selectively folded into a storage position along the deck. The backs of the chairs may be mounted to the folding brackets so that the chair backs are movable into a storage position to permit the backs to fold down between adjacent decks in telescopic platform seating systems. Similarly, an arm rest may be mounted to the folding bracket to fold down with the seat back when the system is retracted. In one embodiment, the armrest may be designed to automatically move into a storage position without external action.

In one embodiment, the system may include program supports that mount to the standards to support the forward end of a deck. The program supports may mount to the front portion of the deck, its understructure, or other members of the telescopic platform system to ensure performance. The program supports may be telescopic or otherwise adjustable in height to provide additional flexibility in configuring the system.

In one embodiment, the system may include a handrail system that is mounted to the rear portion of the standards or the nose beam. For example, the handrail system may be bolted to the rear portion of the upright of select standards. This embodiment positions the handrail such that the chair back serves a portion of the railing's function. In one embodiment the hand rail support system is positioned between adjacent chair backs. In one embodiment, the hand rails are designed to allow use with seating mounted to fixed chairs elsewhere in the arena.

In one embodiment, the system may be reconfigurable to convert a portion of seating into a separated section, such as a team box or scorers area. The team box may include removable front, rear and end walls that help to separate the team box from the other seating. The team box may also include a removable bench for seating players. In one embodiment, these components are removably mounted to the platforms, the nose beams or the framework. If desired, the framework may be configured to provide a low profile platform for the team box. In one embodiment, the team box may be provided over a single platform having substantially greater depth than the other platforms. This platform may include a front portion that is selectively foldable onto the rear portion.

The present invention provides a platform seating system that is easily reconfigurable to provide a wide variety of seating configurations. The present invention is well-suited for use with both fixed and telescopic systems. The seat support components may be easily installed and removed from the decks. The standards provide a strong and durable support that is easily installed and removed from the nose beam and add increased functionality. The standards permit individual chair seating to be installed in a suspended position off the front of the decks. Because the standards are configured to receive the program supports and the handrail system, the programs supports and the handrail system can be installed and removed as desired without the use of additional brackets or other hardware. This makes it easier to reconfigure the seating system as desired with less complexity. Further, the standards are configured so that the program supports and the handrail system can be installed without removing the chairs from the standards. In embodiments where the program supports are vertically extendible, the programs supports are easily adaptable for use with decks at different levels. In embodiments incorporating, for example, a team box, the platform seating system provides an even greater range of flexibility allowing a section of seating to be easily converted into a team box or other function.

These and other objects, advantages, and features of the invention will be readily understood and appreciated by reference to the detailed description of the current embodiment and the drawings.

DESCRIPTION OF THE CURRENT EMBODIMENT

Figure 1:
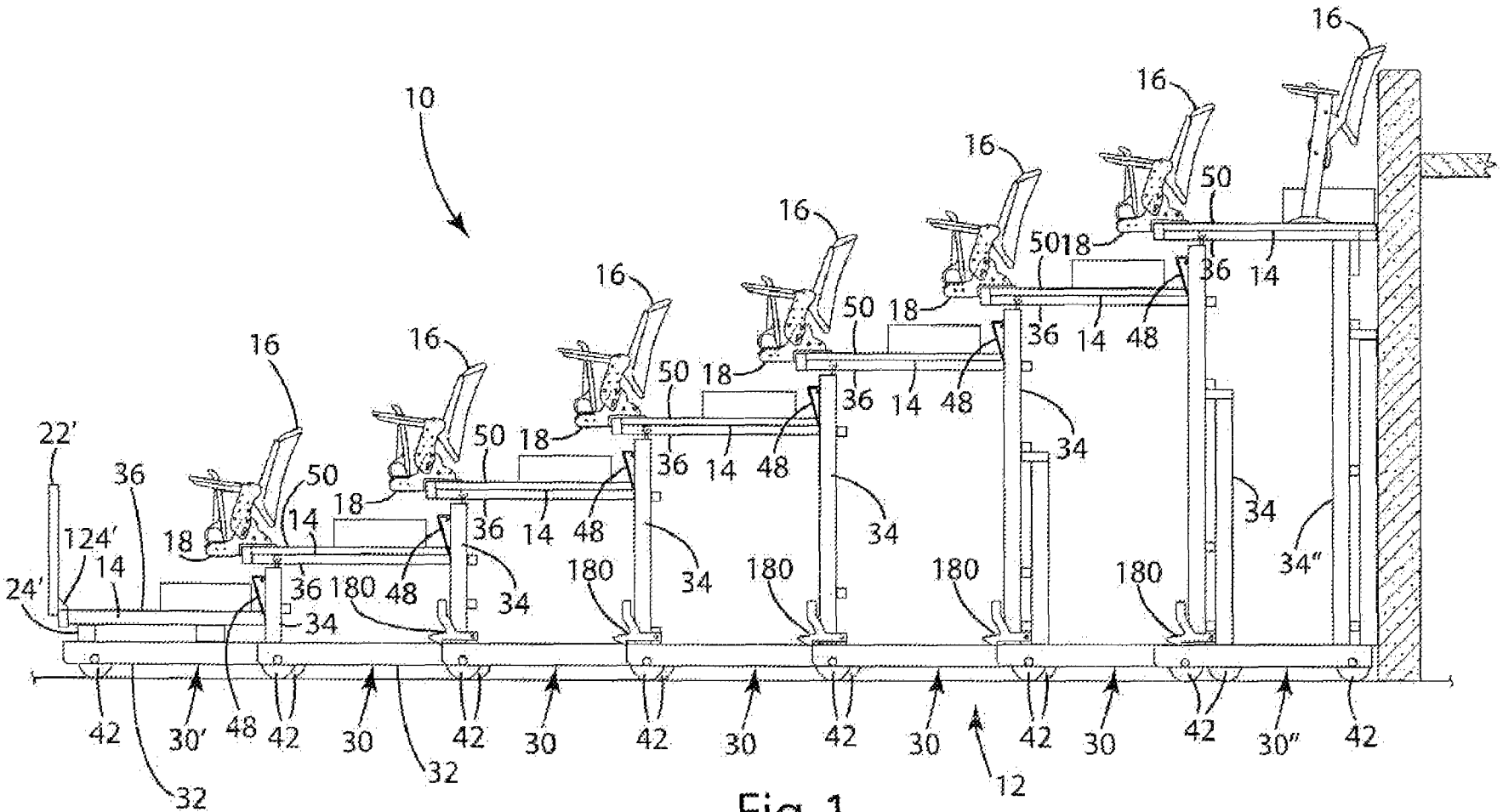
FIG. 1 is a side elevational view of an extended platform seating system in accordance with an embodiment of the present invention.

A multi-configurable platform seating system in accordance with an embodiment of the present invention in shown in FIG. 1 and generally designated 10. In this embodiment, the platform seating system 10 generally includes a framework 12 that supports a plurality of decks 14. A plurality of chairs 16 are mounted to each deck 14 to provide seating. The chairs 16 are mounted to the framework 12 by standards 18 through a nose beam. The standards 18 are configured to selectively receive a plurality of program supports 20, which may be used to support a deck 14 when the system 10 is in a partially retracted configuration. A handrail assembly 22 and other accessories may also be mounted to the standards 18. The platform seating system 10 may also include one or more sections of seating that are reconfigurable to provide a team box. For purposes of disclosure, the present invention is described in connection with a telescopic framework 12 that permits one or more rows of decks 14 to be retracted into the remainder of the framework 12. The present invention is, however, well-suited for use with other types of retractable or fixed systems, or systems that have both fixed and retractable portions.

1. Framework.

As noted above, the platform seating system 10 includes a framework 12 that provides the infrastructure for the seating system 10. In this embodiment, the framework 12 is telescopically retractable, meaning that the framework 12 can be reconfigured to nest one or more decks 14 within the remainder of the framework 12 to store unneeded rows of seating. Storing unneeded rows of seating provides additional floor space.

In the illustrated embodiment, the framework 12 includes a support structure 30 for each deck 14 (or level of the seating system 10). The support structures 30 are interconnected, but are also configured to selectively nest inside of each other as described in more detail below. Each support structure 30 generally includes a base support assembly 32, an upright support assembly 34, and a tread support assembly 36. The base support assembly 32 includes a pair of end beams 40 that are supported upon wheels 42 that facilitate movement of the support assembly 32. The upright support assembly 34 extends substantially vertically from the base support assembly 32, and includes an arrangement of support members 44 that interconnect to provide appropriate structural support. The tread support assembly 36 includes a plurality of deck supports 46 that extend substantially perpendicularly from the upright support assembly 34 to provide a support structure for the deck 14. In this embodiment, a nose beam 38 is mounted along the forward end of the tread support assembly 36 to provide a structural member for supporting chairs and other components. The nose beam 38 may be bolted or otherwise removably mounted to the tread support assembly 36. The tread support assembly 36 may include additional support members that are bolted or otherwise attached to the nose beam 38, or other portions of the tread support assembly 36 as needed for a particular application. Each framework 12 may be broken down into smaller components for shipping. For instance, the tread support assembly 36 may be shipped as a single piece that can be easily mounted to the upright support assembly after arriving at the desired destination. In one embodiment, one or more adjacent nose beams 38 may be connected end-to-end, for example, by using a member (not shown) that slides inside of and is mechanically fastened to the nose beams 38, or by a plate that attaches to the outer surface of the adjacent nose beams 38.

For each support structure 30, except the support structure 30 for the topmost level, the upright support assembly 34 extends upwardly into operative engagement with the tread support assembly 36 of the support structure 30 for the immediately higher level. In the illustrated embodiment, the upright support assembly 34 includes a pin 35 that passes into the interior of the tread support assembly 36. The pin 35 may be operatively connected to a follower assembly 37 fitted into the interior of the tread support assembly 36. When the support structure 30 is fully extended, the upright support assembly 34 is disposed near the forward edge of the tread support assembly 36 of the next highest support structure 30. This provides vertical support for the forward edge of the next highest support structure 30. The support structure 30' for the lowermost deck 14 differs somewhat from the standard support structure 30 in that it includes a second upright support assembly 34' at the front and rear of the support structure 30'. The support structure 30" for the topmost deck 14 also differs somewhat from the standard support structure 30. Because there is no support structure above the topmost deck 14, the support structure 30" for the topmost deck 14 includes an upright support assembly 34" that terminates as desired, for example, at the tread support assembly 36 or at the top of the kick-plate 48.

Although a telescopic framework 12 is described, the present invention may be incorporated into other types of retractable platform seating systems. It may also be incorporated into systems with a fixed framework or a combination of retractable and fixed frameworks. The present invention may also be incorporated into turn-table platform seating systems. A variety of turn-table platform seating systems are currently available so this alternative will not be described in detail. A conventional turn-table platform seating system essentially includes two different platform seating systems mounted back-to-back for interchangeable use. In use, the system may be rotated 180 degrees (like a turn-table) to position either one of the two platform seating systems forward for use. The two platform seating systems may include different platform arrangements and/or different seating configurations. For example, one framework may include more decks and rows of bench seating to provide increased seating capacity while the other framework may include fewer decks and rows of individual chairs to provide improved comfort.

As discussed briefly above, the platform seating system 10 includes a plurality of decks 14. The decks 14 are mounted to the framework 12. The system generally includes one or more treads 50 that are secured to deck support assembly 36, for example, by fasteners or welding. In some applications, it may be unnecessary to secure the treads 50 and they may simply be dropped in place on the deck support assembly 36. Typically, the treads 50 will be essentially coextensive with the horizontal extent of the deck 14 so that there are no spaces or openings through which objects may fall through the treads 50 into the underlying framework 12.

In the illustrated embodiment, each deck 14 also includes a kick-plate 48 to provide a rear wall to the deck 14. The kick-plate 48 may be mounted to the upright support assembly 34 and/or the treads 50. The kick-plate 48 may span the entire rise of the next higher support structure 30 to close the gap and help to prevent objects from falling off of the deck 14 into the framework 12.

Figure 4:
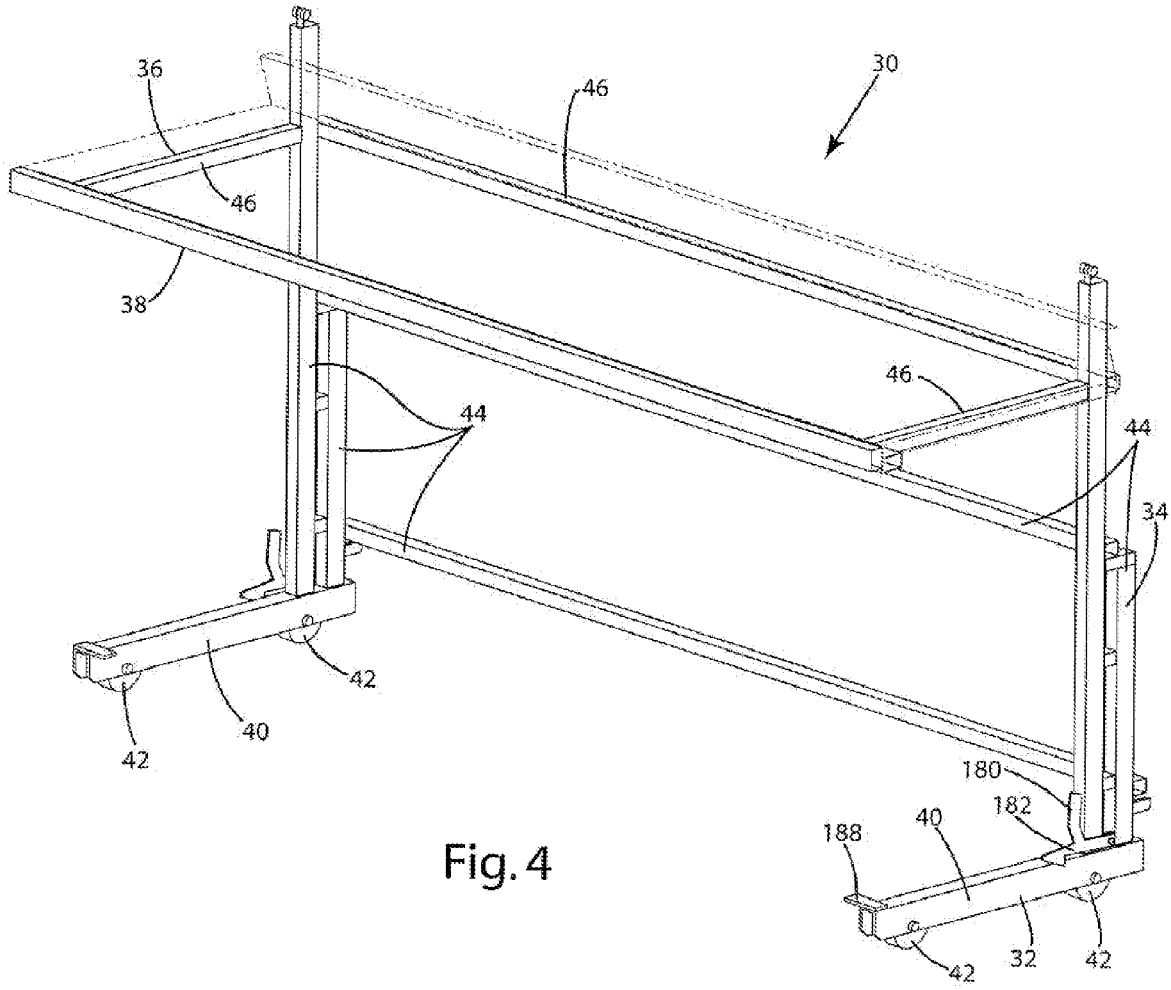
FIG. 4 is a perspective view of a single typical support structure.
Figure 4A:
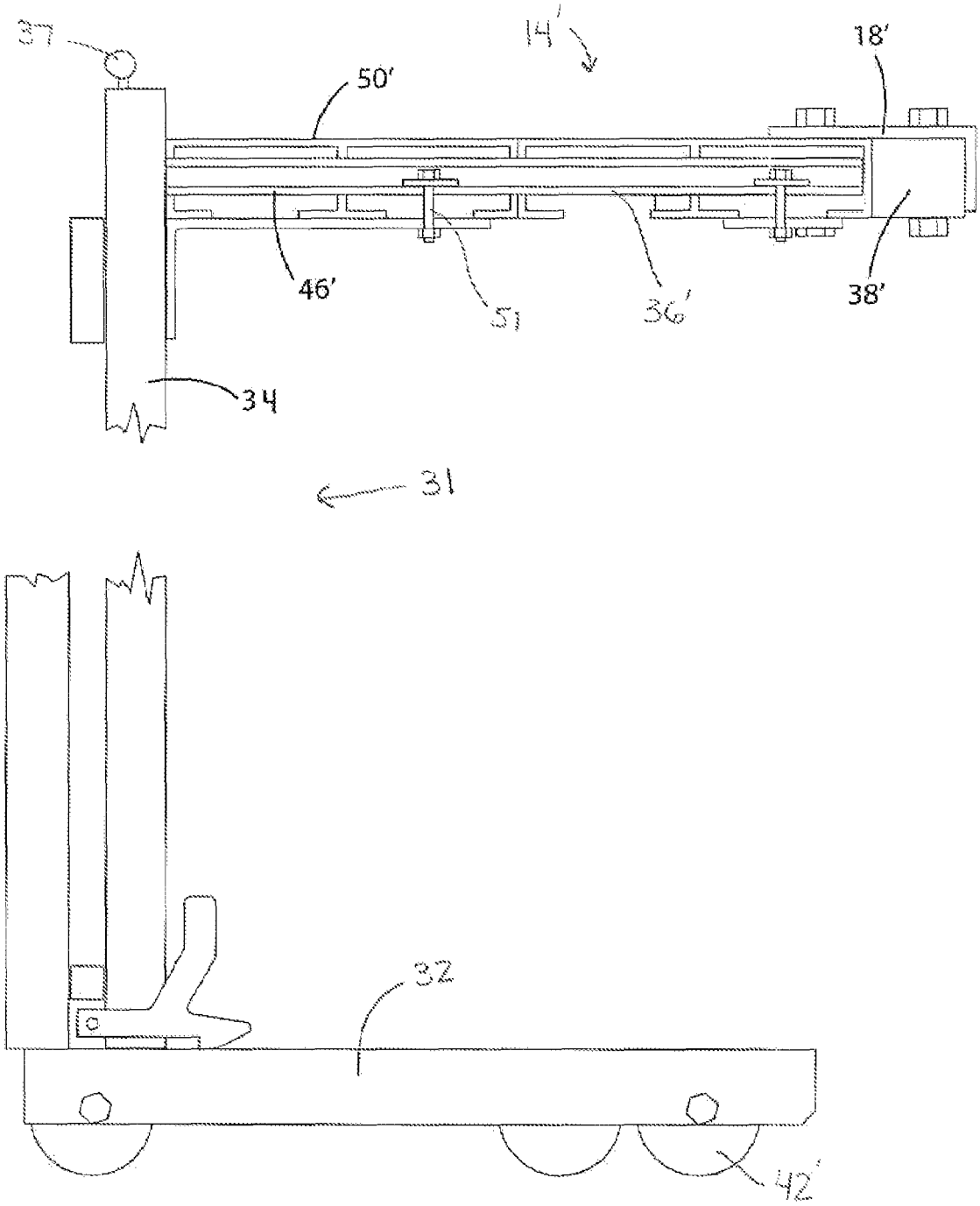
FIG. 4A is a side view of an alternative support structure.
Figure 5:
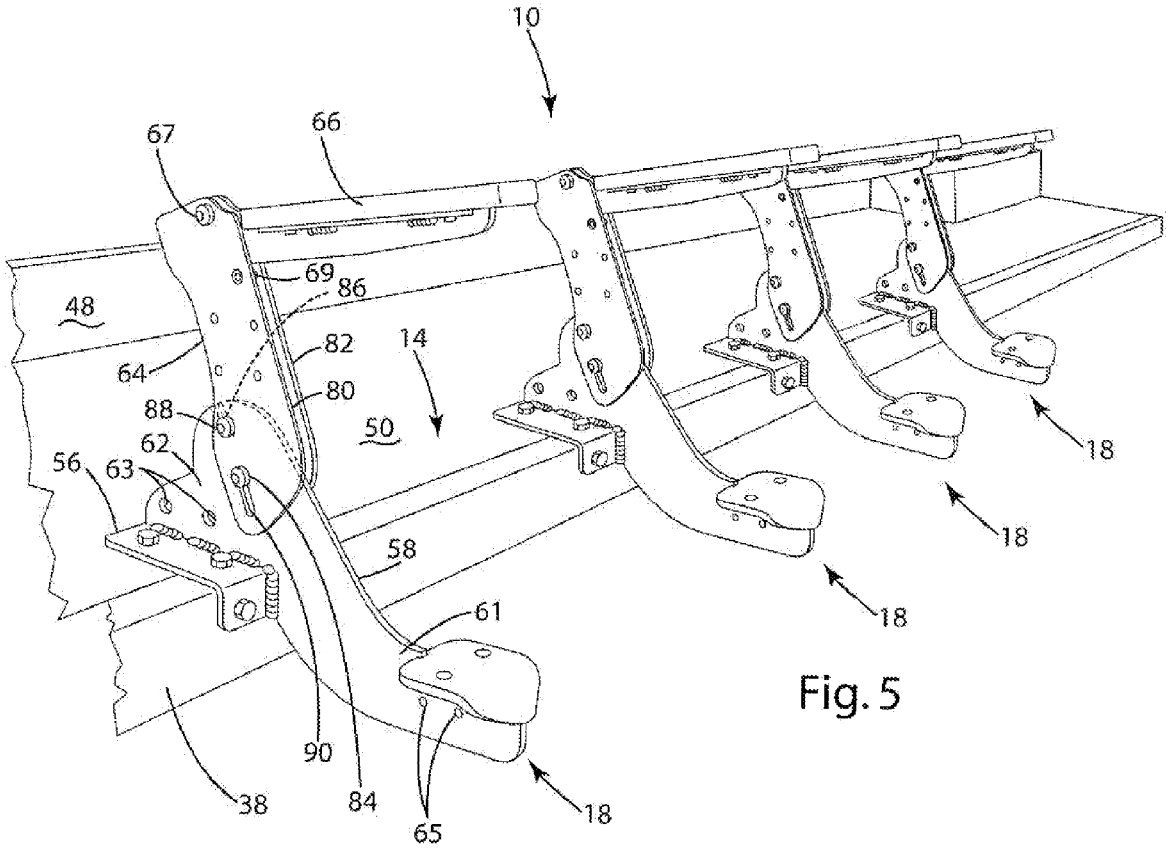
FIG. 5 is a perspective view of a portion of the system showing a plurality of standards with the chairs removed.

FIG. 4A shows an alternative, space-saving embodiment of the deck 14' and support structure 31, wherein at least some of the tread support structure 36', including deck supports 46', are recessed into the tread 50'. In the illustrated embodiment, portions of the interior structure of the tread 50' are removed such that the deck support structure 46' can be inserted through the interior of the tread 50'. The deck support 46' may be attached to the tread 50' with standard bolts 51, or by another conventional method. A nose beam 38' may be attached to the deck 14' in a similar manner to that described above, for instance, with a standard 18'. Although not shown, a plurality of chairs 16 can be mounted to the standards 18'. This embodiment provides additional space between adjacent decks 14', allowing decks to be placed closer together, without requiring drastic alterations to the seats or other components.

2. Seating.

A plurality of chairs 16 are mounted off the forward edge of the tread support assembly 36 to provide a row of seating. In the illustrated embodiment, each chair 16 is mounted to the nose beam 38 by a pair of spaced-apart standards 18. A single standard 18 may be used between two chairs 16 to support adjacent sides of the two chairs 16.

As shown, the standards 18 of the illustrated embodiment are shaped to be fitted over the top and front of the nose beam 38. Each standard 18 generally includes a nose bracket 56, an upright 58 and a folding bracket assembly 64. The nose bracket 56 is configured to mount to the nose beam 38, and, in this embodiment, is shaped to fit closely over the top and front of the nose beam 38. The nose bracket 56 may be removably secured to the nose beam 58, for example, by bolts or other fasteners. The upright 58 extends from the nose bracket 56 in an upright orientation. The upright 58 is configured to receive chairs 16 and other accessories, such as the handrail system and the program supports. In this embodiment, the upright 58 is secured to the nose bracket 56 by welding. The upright 58 generally includes a rear portion 62 extending over the deck 14 and a front portion 61 extending beyond the front the deck 14. The rear portion 62 defines a plurality of apertures 63 for removable connection of the handrail assembly 22 (or other accessories), as described in more detail below. The front portion 61 defines a plurality of apertures 65 for removable connection of the program supports 20 (or other accessories), as described in more detail below.

Figure 2:
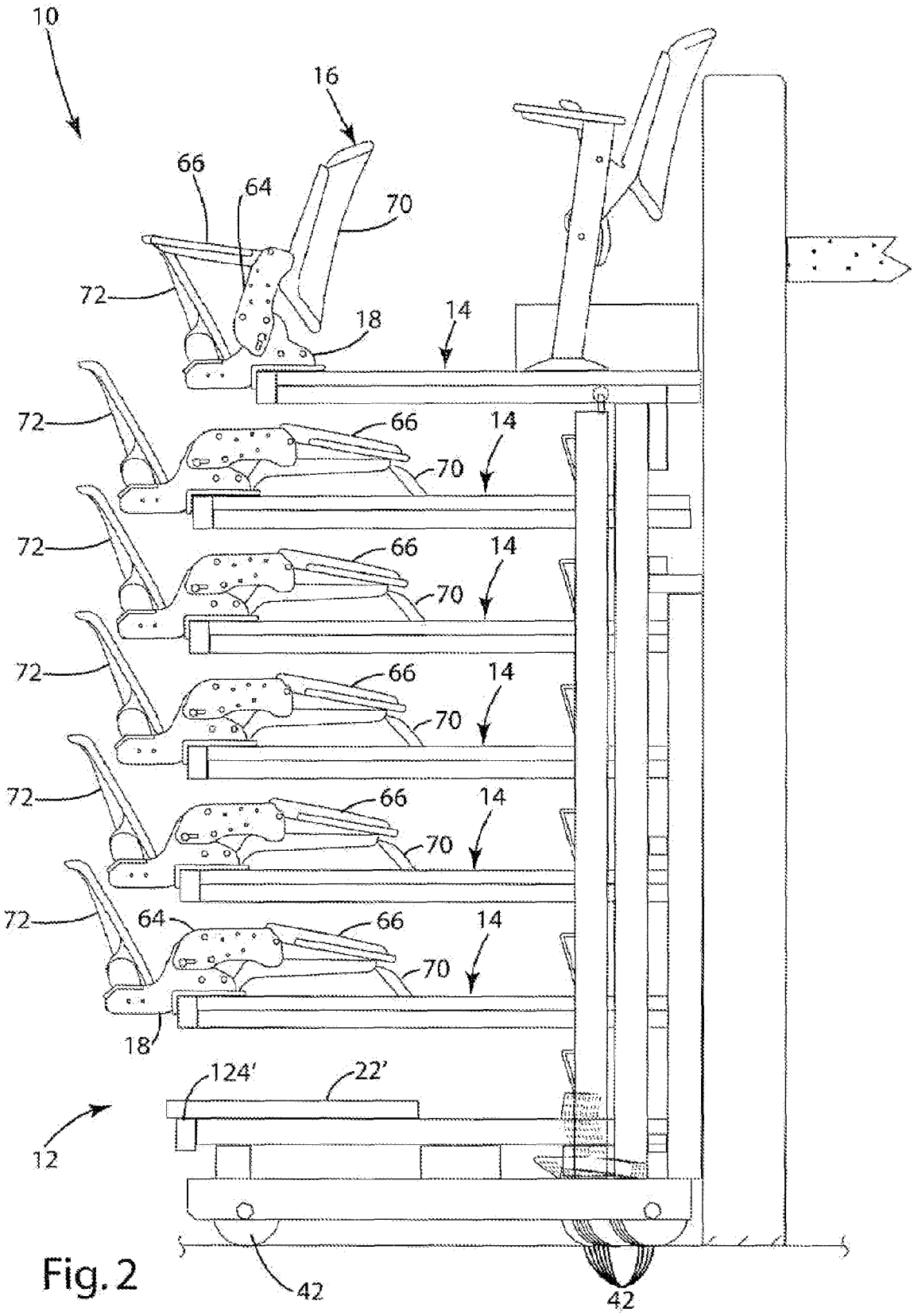
FIG. 2 is a side elevational view of the platform seating system in a fully retracted configuration.
Figure 3A:
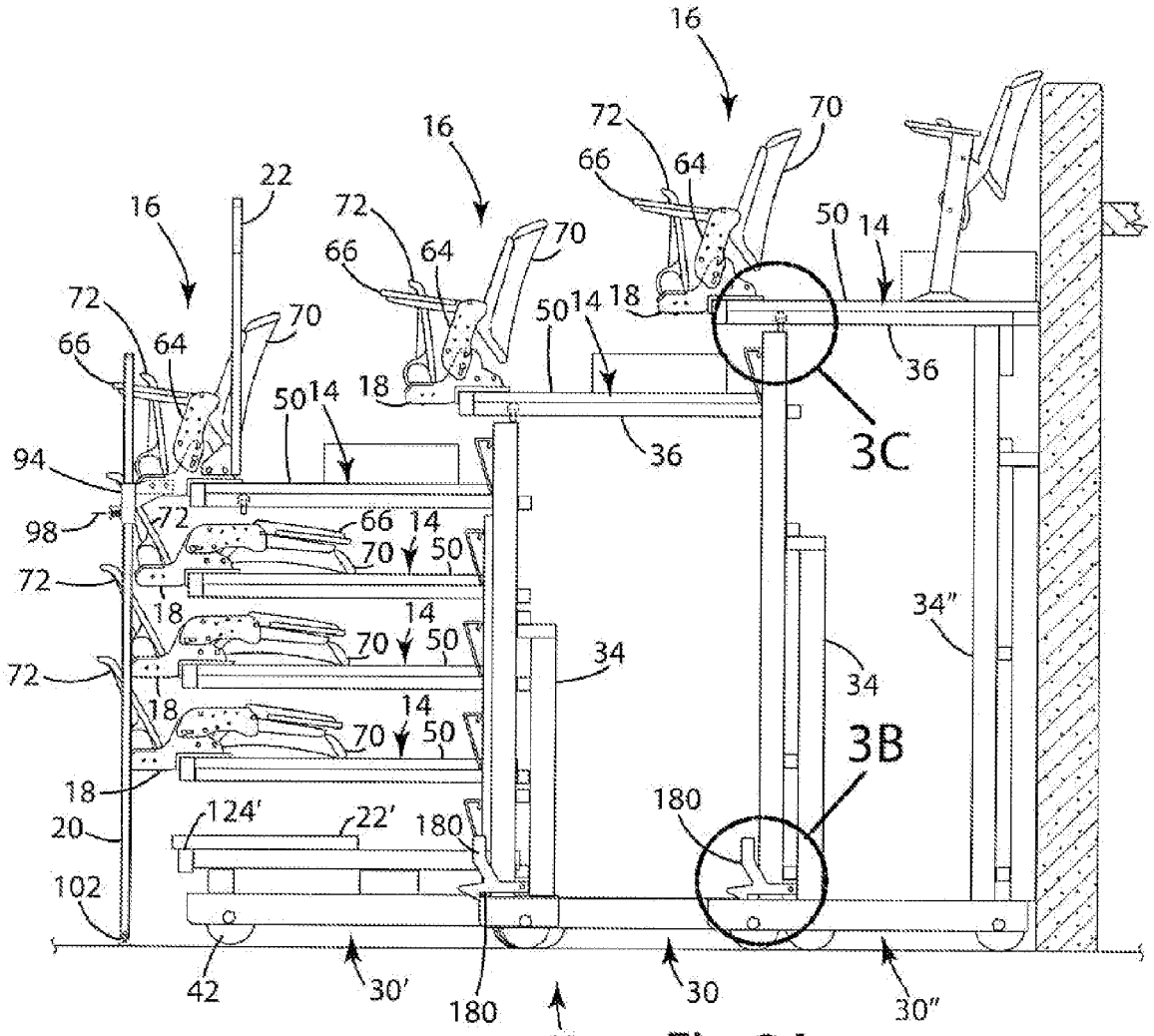
FIG. 3A is a side elevation view of the platform seating system in a partially retracted configuration.
Figure 3B:
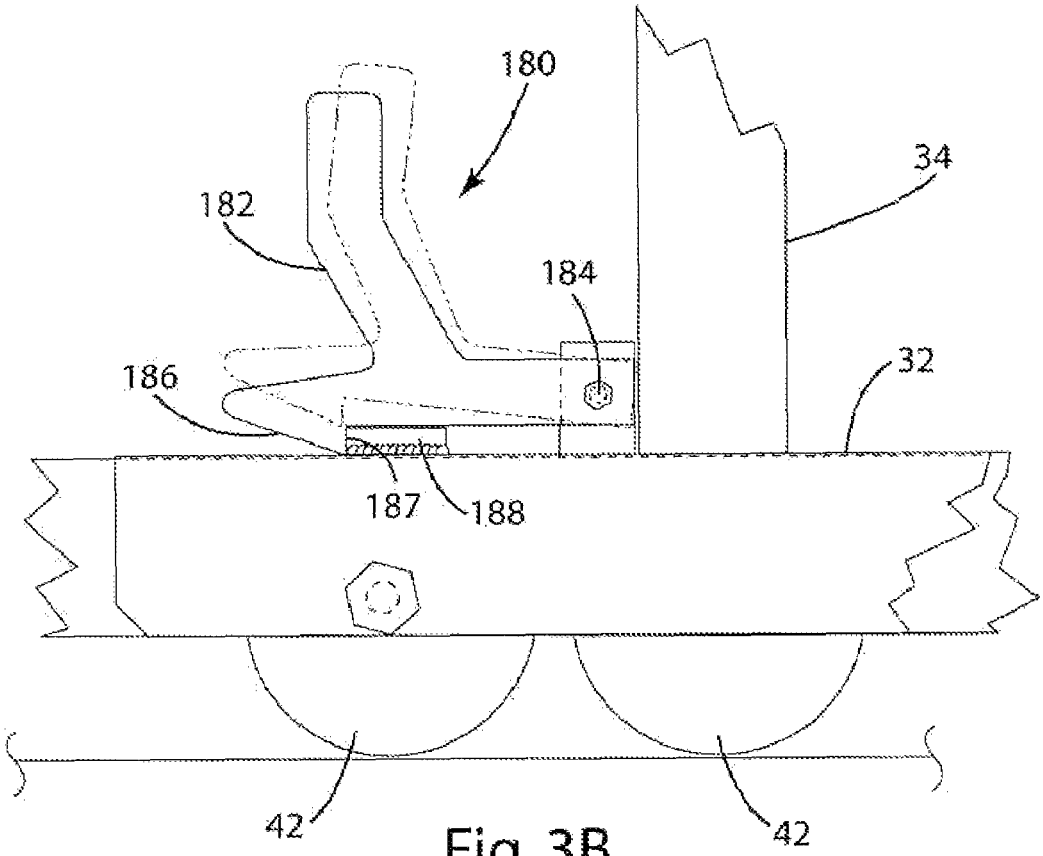
FIG. 3B is an enlarged view of Area 3B in FIG. 3A.
Figure 3C:
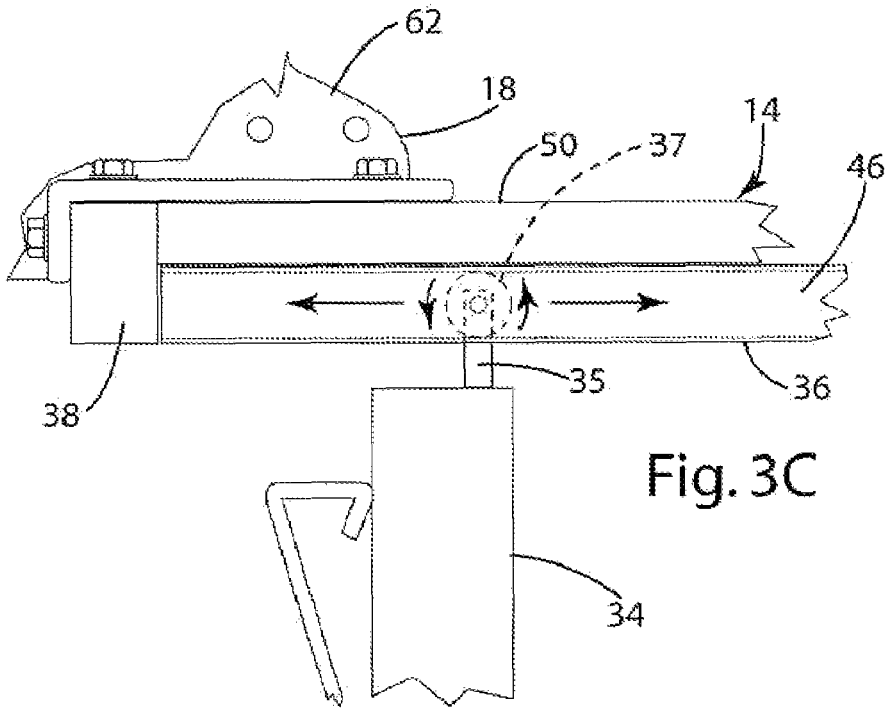
FIG. 3C is an enlarged view of Area 3C in FIG. 3A.
Figure 6A:
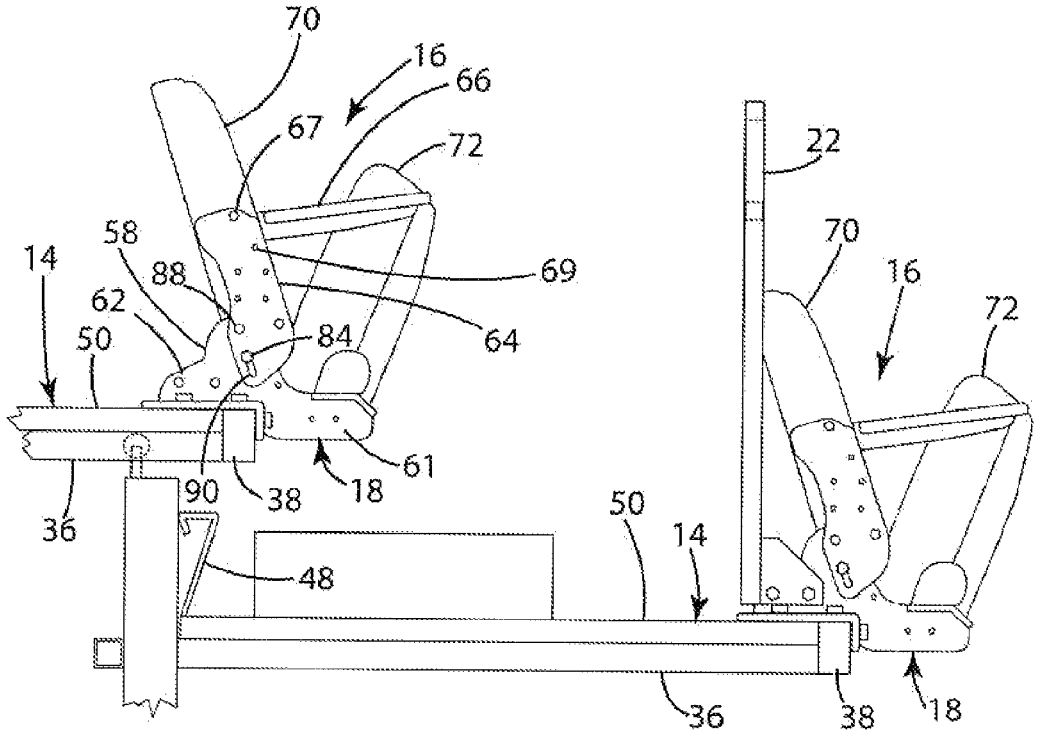
FIG. 6A is side elevational view of a portion of the system showing portions of two platforms.

The folding bracket assembly 64 is pivotally mounted to upright 58 and is selectively movable between an upright position (See FIG. 6A) and a storage position (See FIGS. 2 and 3A). In the illustrated embodiment, the bracket assembly 64 includes a pair of interconnected plates 80, 82 that sandwich the upright 58. The plates 80, 82 may be secured in a spaced relationship by shoulder bolts, spacers or other similar components. A pair of low friction elements (not shown), such as sheets of Teflon® material may be disposed between the plates 80, 82 and the upright 58 to facilitate smooth and easy movement of the bracket assembly 64 with respect to the upright 58. Alternatively, other low friction elements, such as bushing or bearings may be used to facilitate movement of the bracket assembly 64. In this embodiment, the plates 80, 82 are slidably and pivotally secured to the upright 58 by a pin and slot arrangement. The pin and slot arrangement permits the bracket assembly 64 to be lifted and then pivoted with respect to the standard 18 into the storage position. As shown in FIG. 6A, the upright 58 includes a pivot pin 84 and defines an elongated slot 86. The bracket assembly 64 includes a locking pin 88 that extends between the plates 80, 82 and is configured to interact with the upright slot 86. Each plate 80, 82 defines an upright slot 90. The pivot pin 84 extends through the upright slots 86. The pins and slots interact to shepherd and limit movement of the bracket assembly 64 with respect to the upright 58. When the bracket assembly 64 is lifted, the locking pin 88 moves out of upright slot 86. Once the locking pin 88 is outside of the upright slot 86, the bracket assembly 64 can be pivoted about the pivot pin 84 to move the bracket assembly 64 into the storage position. The bracket assembly 64 can be returned to the upright position by pivoting the bracket assembly 64 up about the pivot pin 84 until the locking pin 88 is aligned with the upright slot 86 and then lowering the bracket assembly 64 so that the locking pin 88 is fitted into the slot 86.

In the illustrated embodiment, each chair 16 generally includes a back 70 and a seat 72. The chair back 70 is mounted to the bracket assembly 64 so that it is selectively movable between an upright position and a storage position through actuation of the bracket assembly 64. The chair back 70 may be bolted, welded or otherwise secured to the bracket assembly 64. The chair seat 72 is mounted to the front portion 64 of the standard 18 so that the seat 72 is suspended in front of the deck 14. The seat 72 may be mounted to the front portion 64 using a conventional spring-loaded hinge (not shown) that biases the seat in a folded position. In the illustrated embodiment, the seat back 70 folds rearwardly into the folded position, however, it may otherwise be configured to fold forward.

In the illustrated embodiment, an armrest 66 is pivotally mounted to the bracket assembly 64 to provide a foldable armrest 66. The armrest 66 of this embodiment is fitted between the plates 80, 82 and is secured to the bracket assembly 64 by a bushing 67 or other fastener. The bracket assembly 64 may include a limit pin 69 that functions as a stop in one direction to hold the armrest 66 in a substantially horizontal orientation for use, and in a second direction to hold the armrest 66 in a substantially upright position. The armrest 66 may be mounted to the bracket assembly 64 such that gravity will cause the armrest 66 to pivot into the storage position automatically when the bracket assembly 64 is moved into the storage position. In this embodiment, the limit pin 69 is positioned such that the armrest 66 may move into an over center position when the bracket assembly 64 is folded into the storage position. Once in an over center position, gravity causes the armrest 66 to continue to pivot down into its storage position.

Figure 6B:
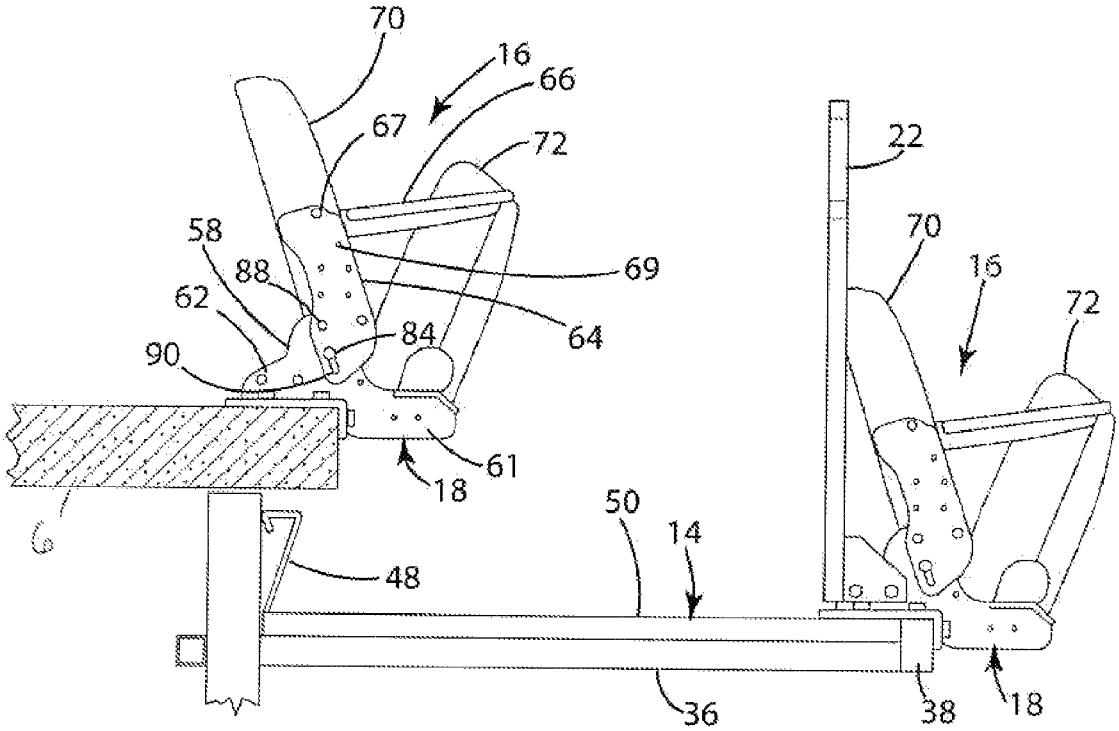
FIG. 6B is a side elevational view similar to FIG. 6A showing the rail system reconfigured to a different row than in FIG. 6A.
Figures 7, 8:
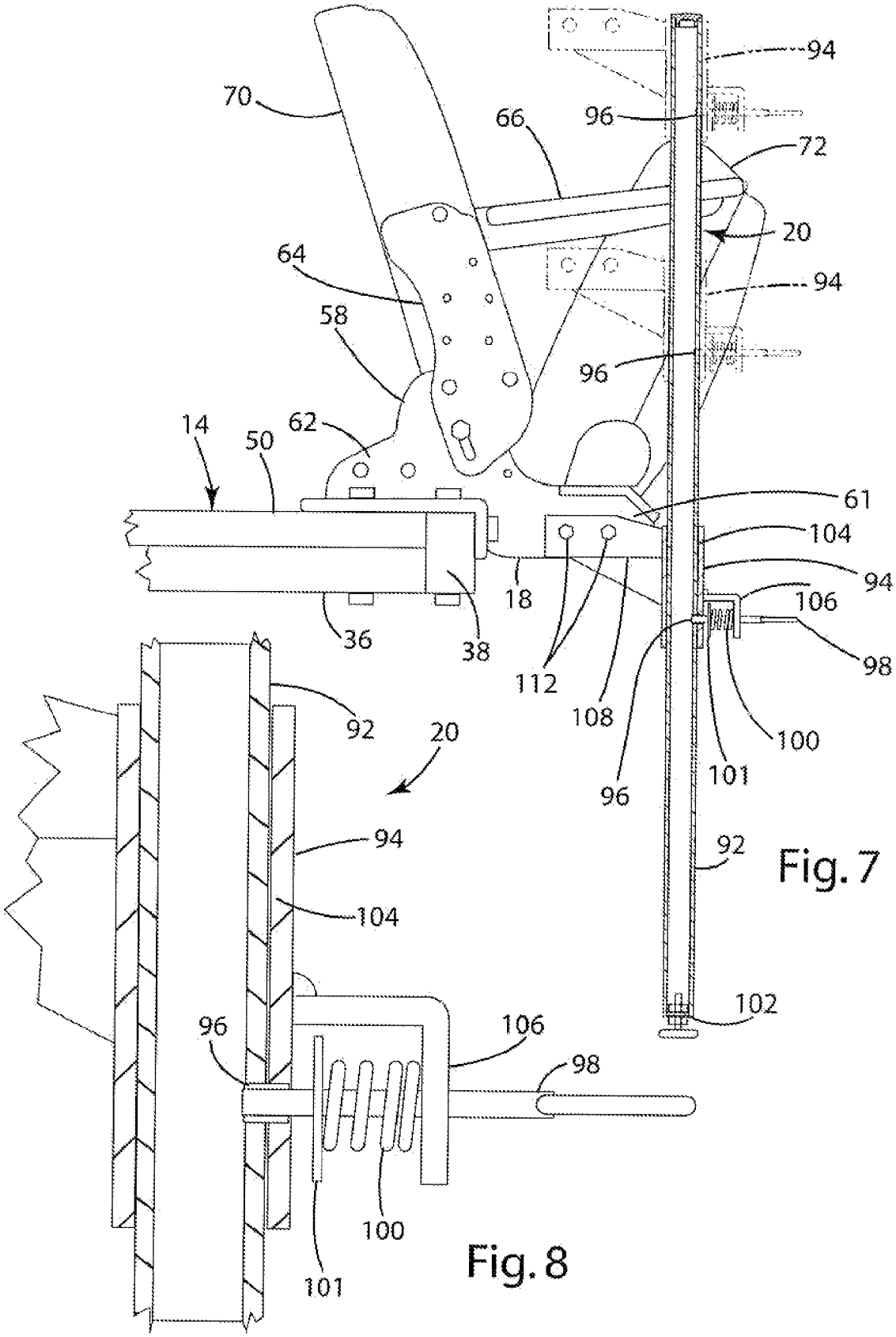
FIG. 7 is a side elevational view of a portion of the system showing a program support mounted to a standard with the program bracket shown in alternative position in phantom lines.
FIG. 8 is a side view of a portion of a program support showing the program bracket mounted to the column.
Figure 9:
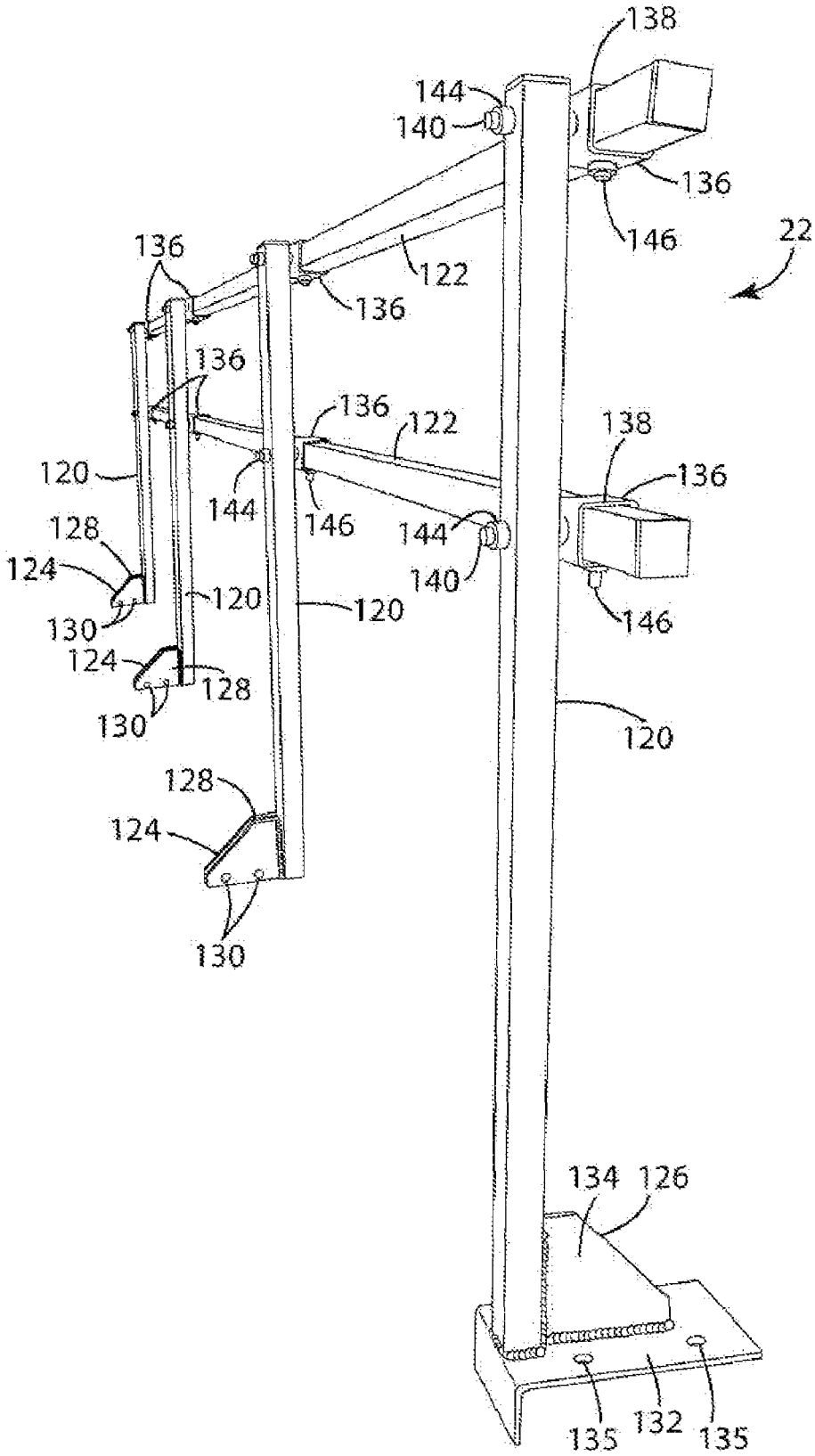
FIG. 9 is a perspective view of handrail assembly.

Although shown in connection with a specific type of auditorium seats, the present invention is well-suited for use with a wide variety of seating options. One alternative embodiment is shown in FIG. 6B, wherein the rearmost seat 16 is mounted to a concrete platform 71 extending from the wall (not shown) or another portion of the venue. In this embodiment, the deck 14 immediately below the concrete platform 71 may be retracted underneath the platform for storage.

3. Program Supports.

The program supports 20 function primarily to provide vertical load support to the forward end of the lowermost used deck 14 when the platform seating system 10 is not fully extended. As noted above, the upright support assembly 34 of each deck 14 provides vertical support for the forward edge of the next higher deck 14 when it is extended. However, when a deck 14 is retracted, the upright support assembly 34 of that deck is moved to the rear edge of the next higher deck 14 and is therefore no longer positioned to provide vertical support for the next higher deck 14. In one embodiment, the program supports 20 are selectively mountable to essentially any standard to provide vertical support for a deck 14 that is not receiving vertical support from the vertical support assembly 34 of the immediately lower deck 14. The program supports may be otherwise mounted to other portions of the deck or its understructure. In the illustrated embodiment, the program support 20 generally includes a column 92 and a program bracket 94. The column 92 is a vertically extending support structure with appropriate length to support the highest desired deck 14. Alternatively, the column 92, or other portions of the program support 20 could extend from the deck at an angle from vertical direction, and could have a curved shape to meet the support needs of a particular application. In the illustrated embodiment, column 92 is a length of steel tube. Although not shown, the column 92 may be adjustable in length to reduce the overall length of the column 92 for storage and/or to accommodate support of decks 14 at different heights. For example, the column 92 may include two or more telescopic portions that can be extended relative to one another to provide gross variation in the height of the column 92. The column 92 may also include an adjustable foot 102 or middle or top bracket to allow fine adjustment of the overall length of the column 92 as may be desirable to accommodate small variations in the level of the floor (not shown). The foot 102 may be a conventional threaded foot and may be mounted in the bottom end of the column 92. The column 92 defines a plurality of bracket locking apertures 96. In this embodiment, the program bracket 94 is movably mounted to the column 92 and is selectively securable in the desired position by a locking pin 98 that is selectively fitted into one of the locking apertures 96 on the column 92. The illustrated program bracket 94 includes a sleeve 104 that is slidably fitted over the column 92. The sleeve 104 may be a segment of steel tube having inner dimensions slightly larger than the outer dimension of the column. A pin retainer 106 may extend from the sleeve 104 to hold the locking pin 98. The locking pin 98 may extend through the pin retainer 106 and the sleeve 104, and may be biased toward the column 92, for example, by a coil spring 100 fitted about the pin 98 between the pin retainer 106 and a spring stop 101 extending from the pin 98. The program bracket 94 also includes a standard clevis 108 that is configured to mount toward the forward portion 64 of the upright 58 of a standard 18. The clevis 108 defines two pair of aligned apertures 110 to receive bolts 112 or other fastener for securing the program support 20 to the standard 18. In use, the locking pin 98 is used to secure the program bracket 94 at the appropriate height to support the desired deck 14 and the program bracket 94 is secured to the appropriate standard 18 by bolt 112.

In an alternative embodiment (not shown), one or more program supports 20 may be used to maintain a desired distance between retracted decks 14 during shipping and transportation of the platform seating system 10. In this embodiment, a program support 20 is attached to a plurality of decks 14, for example, with a plurality of program brackets 94 attached to standards 18, or other portions of the decks 14, as described above. The program brackets 20 may be spaced from each other along the column 92 at desired distances to maintain separation between vertically adjacent decks 14.

4. Handrail Assembly.

The handrail assembly 22 is a removable assembly designed to provide the platform seating system 10 with removable and reconfigurable handrails. The handrail assembly 22 generally includes a plurality of uprights 120 and a plurality of rails 122. In the illustrated embodiment, the uprights 120 and the rails 122 are manufactured from sections of steel tubing, but the stock material may vary from application to application as desired. The uprights 120 define a plurality of mounting apertures 142 for securing the rails 122 to the uprights 120.

In the illustrated embodiment, the uprights 120 include one of two mounting brackets 124 or 126. In alternative embodiments, additional or alternative mounting brackets could be provided. Mounting brackets 124 are intended for mounting directly to the standards 18, such that the uprights 120 are positioned adjacent to a seat 16, and in some cases between two seats 16. Mounting brackets 126 are intended for mounting directly to the deck 14 (or other locations other than a standard 18) in locations where a standard 18 does not exist. In both cases, the mounting brackets 124, 126 may be secured to the uprights 120 by welding, fasteners or otherwise. Mounting brackets 124 generally include a clevis 128 that defines two pairs of mounting apertures 130. The clevis 128 is configured to be fitted over the rear portion 62 of the upright 58 with the mounting apertures aligned with corresponding apertures 63 in the upright 58. The uprights 120 may be secured to the standard 18 by bolts or other fasteners extending through the aligned apertures 63, 130.

Mounting bracket 126 generally includes an L-shaped flange 132 and a brace 134. The L-shaped flange 132 is configured to fit to the deck 14 and/or the nose beam 38. The L-shaped flange 132 defines a plurality of apertures 136 for removably securing the bracket 126 to the deck 14 and/or nose beam 38. The brace 134 forms a web between the L-shaped flange 132 and the upright 120 to provide structural support. In the illustrated embodiment, the L-shaped flange 132 and the brace 134 are intersecured and fixed to the upright 120 by welding.

In this embodiment, the rails 122 are secured to the uprights 120 by rail brackets 136. Alternatively, the rails 122 may be directly secured to the uprights 120 by bolts or other fasteners. Each rail bracket 136 generally includes a rail sleeve 138 and a mounting post 140. The rail sleeve 138 is shaped to slidably receive the rail 122. For example, in the illustrated embodiment, the rail sleeve 138 is a short segment of steel tube having inside dimensions slightly larger than the outer dimension of the rail 122. The mounting post 140 of this embodiment is a threaded shaft that may be fitted through a mounting aperture 142 on the upright 120 and fastened by a nut 144. The rail sleeve 138 may also define a set screw aperture to threadedly receive a set screw 146 for securing the rail 122 in position within the rail bracket 136.

In an alternative embodiment, the handrail assembly 22' may be mounted to a platform 14 using folding brackets 124'. The folding brackets 124' permit the handrail assembly 22' to be folded down toward the deck into a storage position when it is desirable to retract the associated platform 14. FIG. 2 shows an embodiment in which a handrail assembly 22' with folding brackets 124' is mounted to the lowermost platform 14. Although illustrated on the lowermost platform 14, the handrail assembly 22' may be mounted to other platforms 14, as desired. In this embodiment, the height of the handrail assembly 22' is such that the handrail assembly 22' can fold down without interference from the chairs 16 mounted to the next higher platform 14. The folding brackets 124' may have essentially any folding or hinge configuration, depending on the desired storage application. The folding brackets 124' may include a locking mechanism for securing the handrail assembly 22' in the upright position. For example, the handrail assembly 22' may be secured to the platform 14 (e.g. to the nose beam 38) using pre-manufactured brackets with an integrated locking mechanism. Alternatively, the folding brackets 124' may incorporate a pin/slot arrangement, such as the type employed by the folding bracket assembly 64 of the standards 18. As another alternative, the two legs of the folding bracket may define holes (not shown) that align when the folding bracket 124' is in the upright position (not shown). A padlock or other locking mechanism may be passed through the holes to secure the folding bracket 124' in the upright position.

5. Team Box.

In many venues, it is desirable to provide specially configured seating areas. For example, in sports venues, it is often desirable to provide a team box for seating the members of a sports team or a judges' box for seating judges for a sporting event. Similarly, in concert venues, it may be desirable to provide an area for a soundboard and its operators. In this disclosure, the term "team box" will be used to refer collectively to the seating area for these different applications. A team box is typically at least somewhat isolated from the other seating and will often include bench seating rather than individual chairs. It is common for a team box to occupy space immediately adjacent to the sporting even, for example, immediately next a sporting floor, sporting field or ice rink.

Figure 10A:
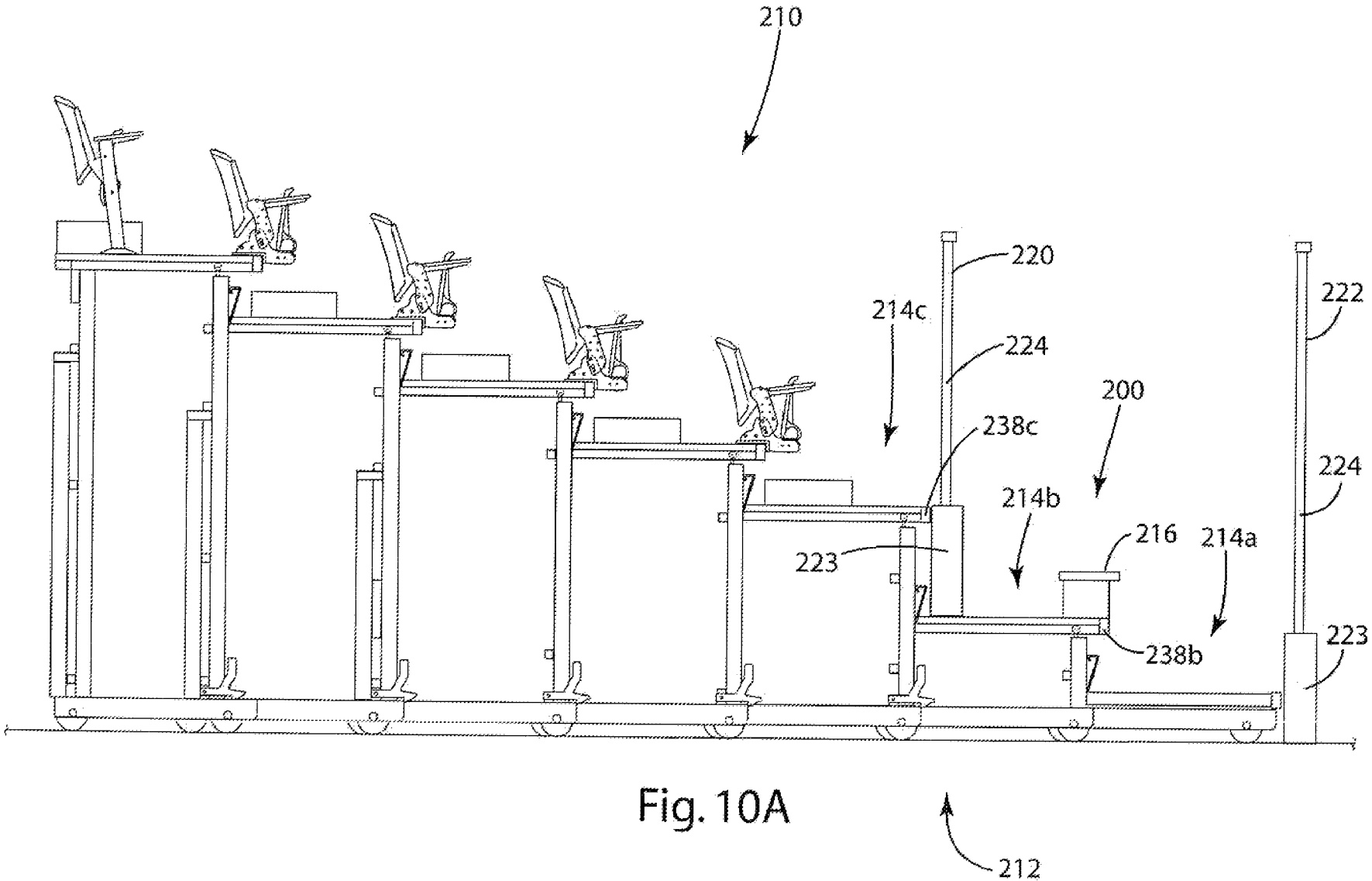
FIG. 10A is a side elevational view of a first alternative embodiment configured to provide a team box.
Figure 10B:
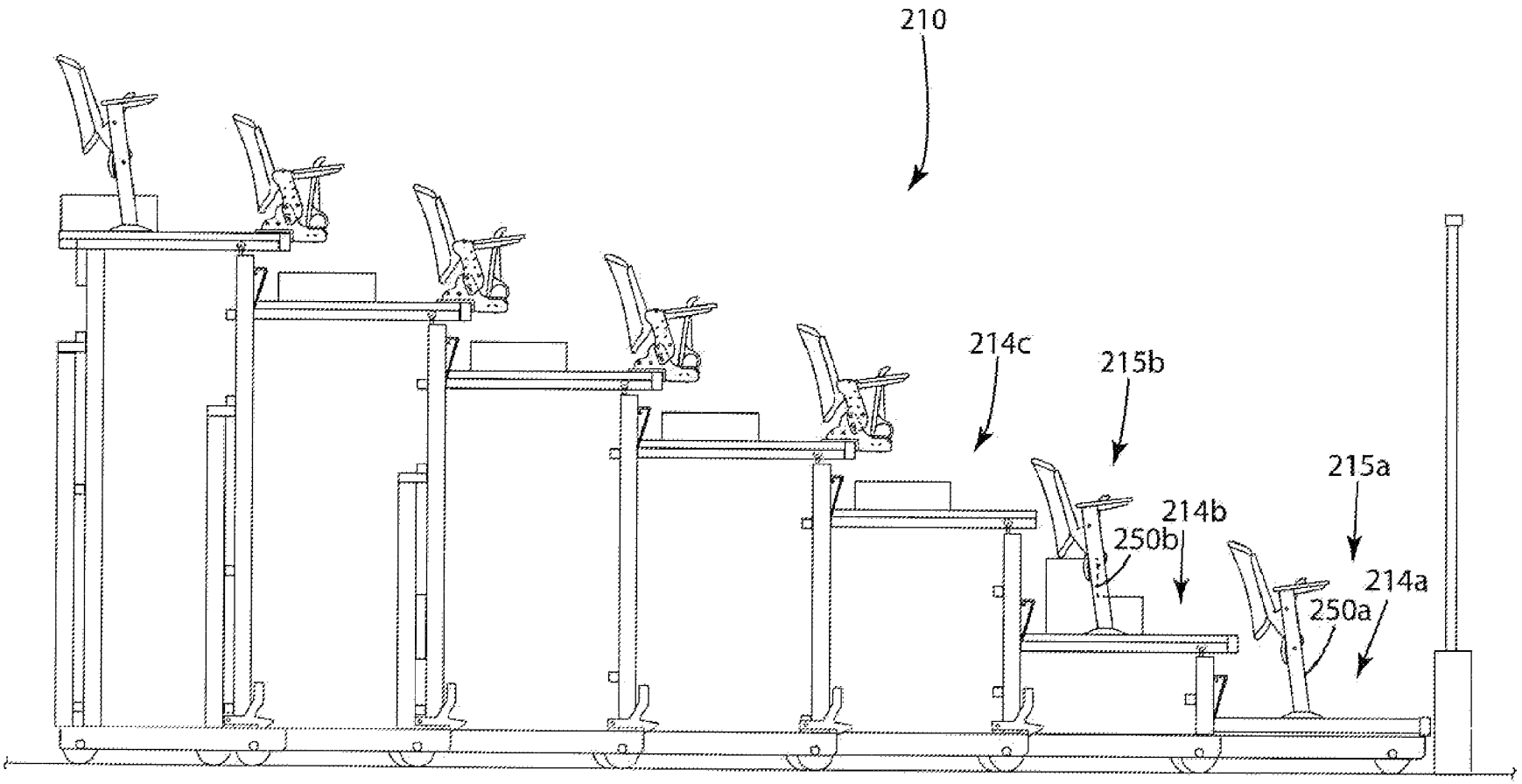
FIG. 10B is a side elevational view of the first alternative embodiment configured without a team box.

In one embodiment, the present invention provides accessories that permit a portion of the platform seating system 10 to be converted for use as a team box (or other similar seating area). In the alternative platform seating system 210 shown in FIGS. 10A-B, the lowermost two decks 214*a*, 214*b* are configured to provide a team box 200. In this embodiment, the chairs have been removed from the nose beams 238*b*, 238*c* of the second and third lowermost decks 214*b*, 214*c*. In their place, a bench seat 216 has been removably mounted to the second lowermost deck 214*b*. The bench 216 may be mounted to the deck 214*b* or to the nose beam 238*b*, for example, by pins that pass through corresponding openings in the nose beam 238*b*. To facilitate entering and exiting the team box 200, the system 210 may include a low profile framework 212 that positions the lowermost deck 214*a* closer to the floor. This may be particularly useful in sporting applications, such as hockey, where players are required to step down from the team box 200 onto ice in skates. In another alternative embodiment, the framework may be provided with smaller wheels and thinner decks to even further reduce the height of the lowermost deck above the floor.

Conventional team boxes typically include a barrier to separate the team box from other seating areas. In the illustrated embodiment, the team box 200 includes a plurality of walls that isolate the team box 200. As shown, the team box 200 includes a rear wall 220 disposed at the rear of deck 214*b*. The rear wall 220 may be of essentially any construction, and may be mounted to the deck 214*b* and/or the nose beam 238*c* of deck 214*c*. The team box 200 may also include a front wall 222. As with rear wall 220, the front wall 222 may be of essentially any desired construction. The front wall 222 may be mounted to the floor and/or to another portion of a deck 214*a*. The team box 220 may also include end walls (not shown) that close off opposites ends of the team box. The end walls (not shown) may be mounted to any suitable support structure, such as the floor or the framework 212. Alternatively (or in addition), the end walls (not shown) may mount to the ends of the rear wall 220 and the front wall 222. The team box 200 may be configured so that it does not interfere with the view of those sitting behind the team box 200. For example, the rear wall 220 and the front wall 222 (and any end walls (not shown)) may include a short wall 222 and/or transparent panels 224.

Figure 11A:
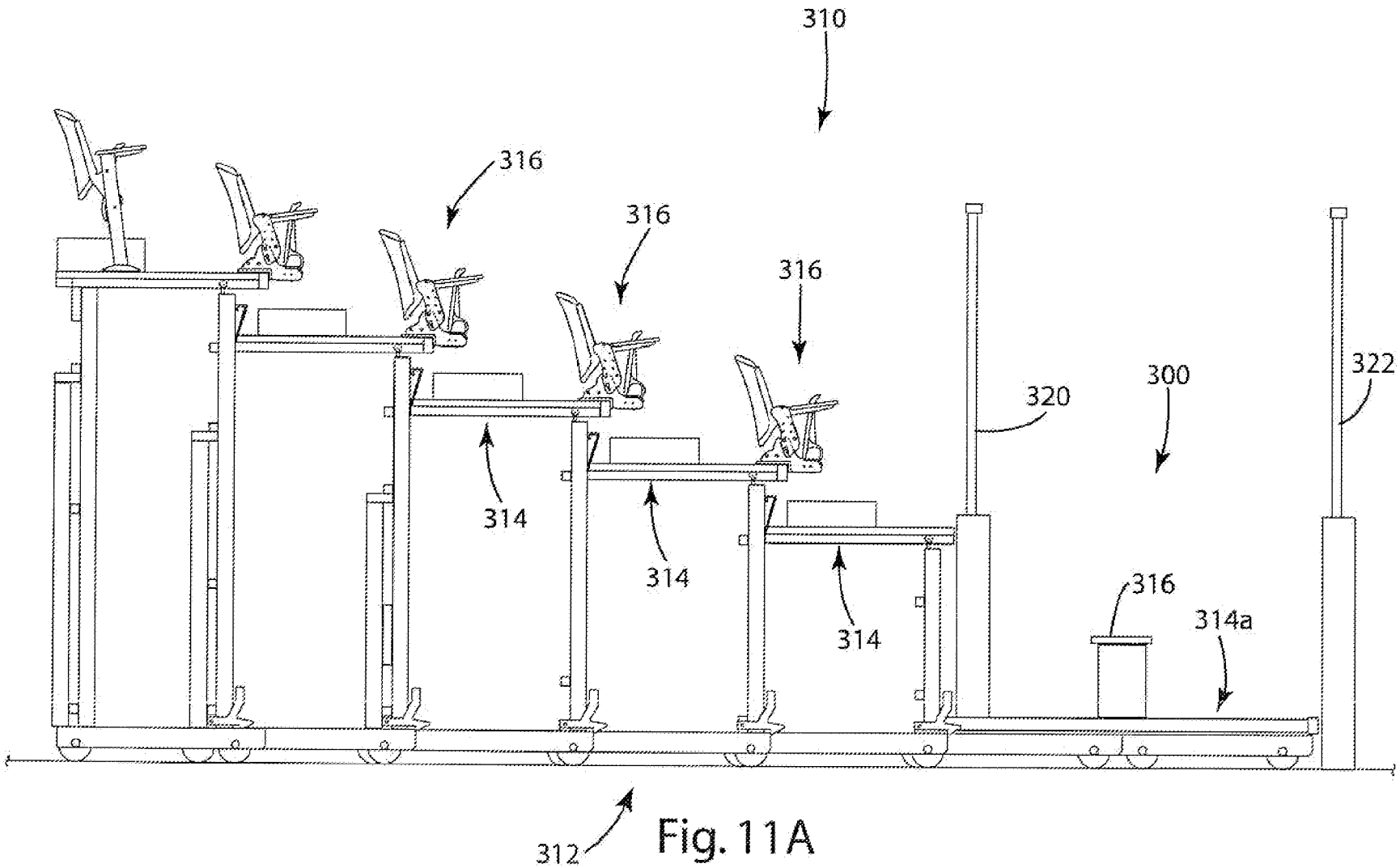
FIG. 11A is a side elevational view of a second alternative embodiment configured to provide a team box.
Figure 11B:
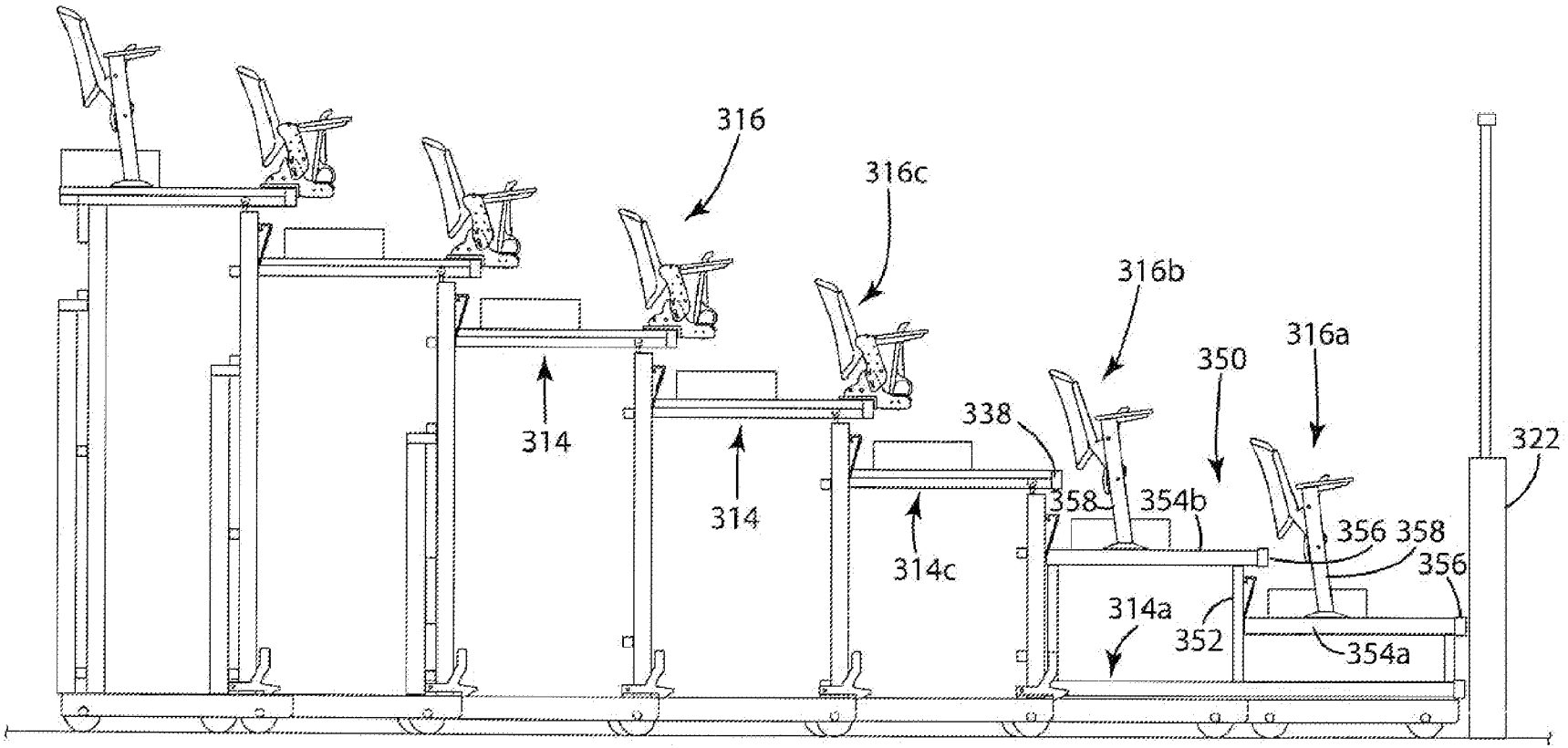
FIG. 11B is a side elevational view of the second alternative embodiment configured without a team box.

In an alternative embodiment shown in FIGS. 11A-B, the platform seating system 310 includes a team box 300 that is situated on a single deck 314*a*, which eliminates the change in floor height inside the team box 200. This may make it easier for occupants to move around within the team box 300. In this embodiment, the lowermost deck 314*a* is approximately twice the width of a standard deck 314. When the framework 312 of this embodiment is retracted, deck 314*a* extends out somewhat from the remainder of the seating system 310. The team box 300 may include a removable bench seat 316, removable a rear wall 320, a removable front wall 322 and removable end walls (not shown). These various components may be removably mounted using essentially the same methods discussed above in connection with team box 200.

The alternative system 310 may also include a removable deck assembly 350 that can be placed atop of deck 314*a* to provide individual chair seating when the team box 300 is not necessary (See FIG. 11B). The removable platform assembly 350 may include a small retractable or fixed framework 352 that has two platforms 354 to provide two additional rows of seating. Each platform 354 may include a nose beam 356 and be configured to receive chairs 16 in essentially the same manner as the other platforms 314. Alternatively, the removable platform assembly 350 may include chairs that are mounted atop conventional standards 358 mounted to the decks 354.

Figure 12A:
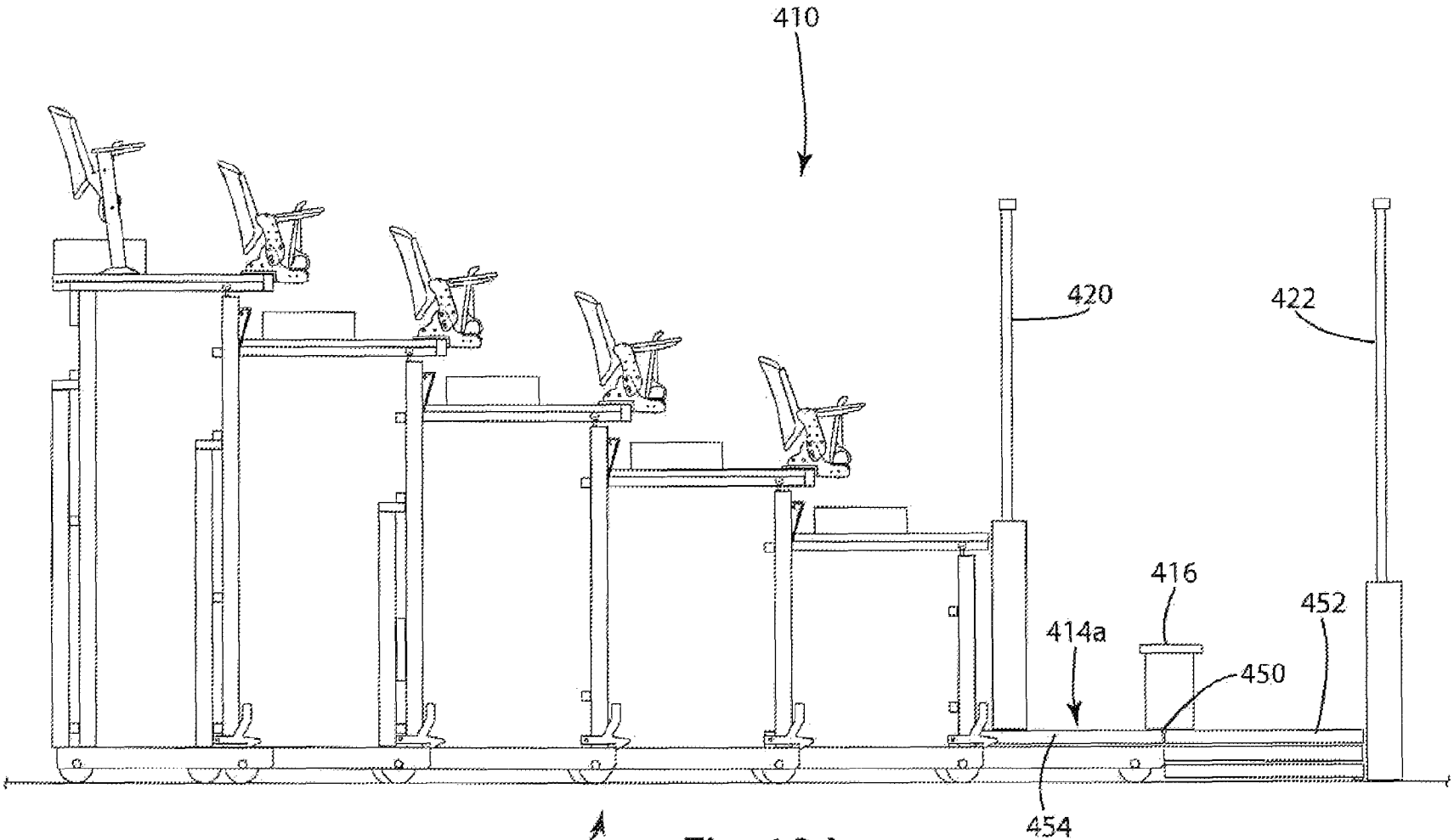
FIG. 12A is a side elevational view of a third alternative embodiment configured to provide a team box.
Figure 12B:
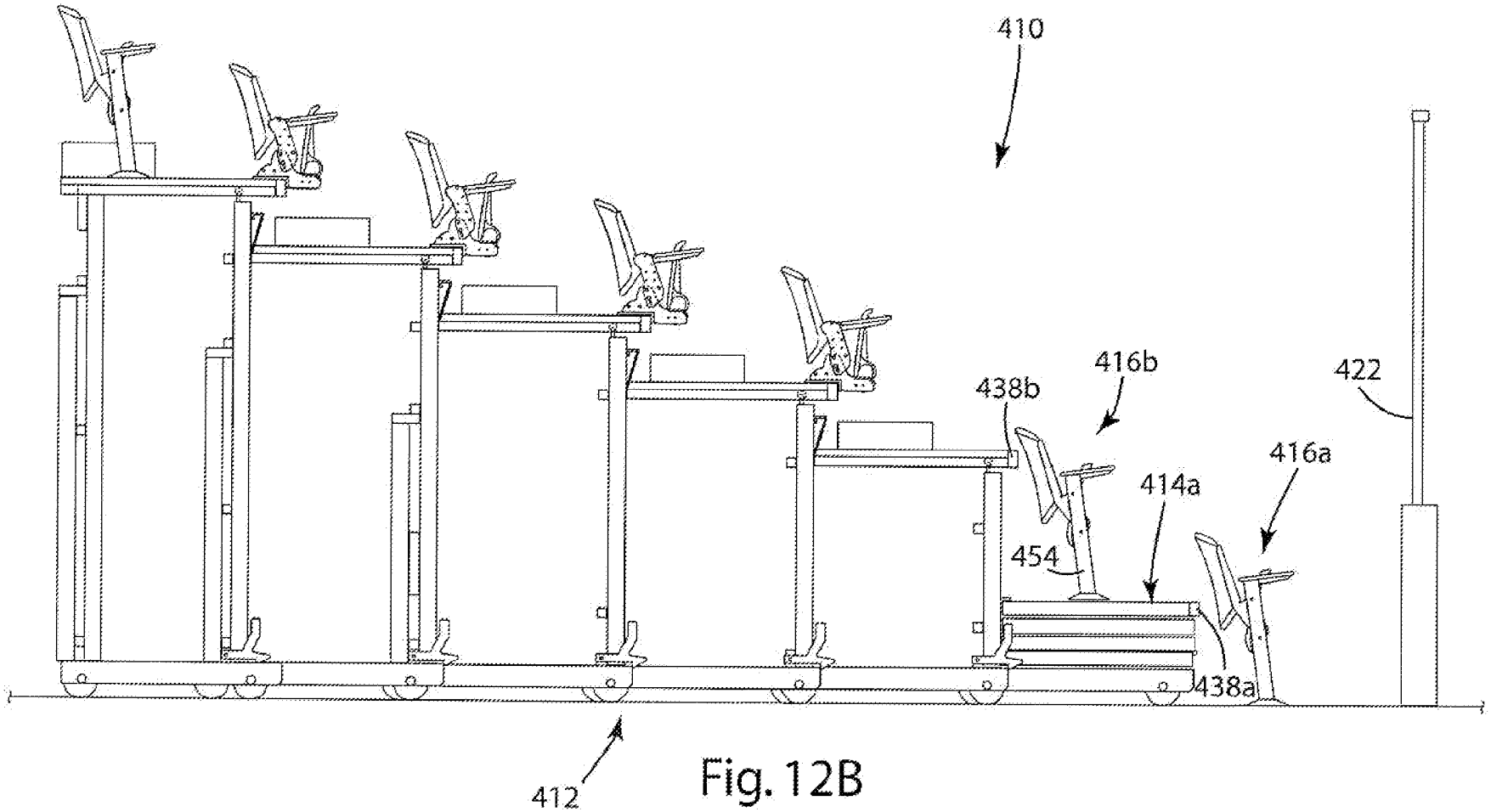
FIG. 12B is a side elevational view of the third alternative embodiment configured without a team box.

Another alternative platform seating system 410 is shown in FIGS. 12A-B. In this embodiment, the system 410 includes a single platform 414*a* that is foldable to provide reduced size for storage. As shown, the platform 414*a* may include a centrally positioned hinge 450 that permit the forward portion 452 of the platform 414*a* to fold back onto the rear portion 454. Alternatively, the hinge 450 may be removed and the forward portion may be manually positioned atop or in front of the rear portion as desired. The deck 414*a* may be sized and shaped so that when folded, it provide a deck 414*a*' suitable for receiving a row of chairs 416. As shown in FIG. 12B, a single row of chairs 416*a* may be mounted to the deck 414*a* using conventional upright standards 454. Additionally, a row of chairs 416*b* may be nose mounted to the front the folded deck 414*a*', for example, to an appropriately positioned nose beam 456. This second row of chairs 416*b* may alternatively be mounted directly to the floor (or simply rest upon the floor), if desired.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A platform seating system comprising;

a framework having a plurality of selectively extendable and retractable support structures;

a plurality of decks, one of said decks mounted to each of said support structures;

a plurality of seats mounted to said decks;

at least one program support removably mounted to one of said decks to provide vertical support to said deck, wherein said program support is mountable to said supported deck without removing said seats mounted to said supported deck; and a section of seating reconfigurable to define a team box, said team box including at least one deck, a removable bench seat and at least one wall mounted at least indirectly to said framework at a rear of said team box deck;

wherein said team box includes a deck having a front portion and a rear portion, said front portion being selectively movable into a position atop said rear portion.

2. The system of claim 1 wherein said front portion is hingedly secured to said rear portion.

3. The system of claim 1 further including a removable deck assembly selectively positionable atop said team box deck, said removable deck including seating.

4. A deck seating system comprising:

a framework having a plurality of support structures, each of said support structures being selectively movable between a storage position in which said support structure is nested within another one of said support structures and a use position in which said support structure is un-nested from said another one of said support structures;

a plurality of decks, one of said decks being mounted to each of said support structures;

a plurality of structural members, one of said structural members being disposed at a forward position of each deck, each of said structural members defining a plurality of standard mounting interfaces;

a plurality of standards, each of said standards being removably mounted to one of said structural members at one of said standard mounting interfaces;

a plurality of seats removably mounted to said standards; and a section of seating selectively configurable as a team box, said reconfigurable section of seating including at least one team box deck, wherein said team box includes a rear wall mounted toward a rear of said team box deck;

wherein said team box includes a front wall mounted toward a front of said team box deck, said front wall being mounted to at least one of said team box deck and a floor upon which the system is positioned.

5. The system of claim 4 wherein said team box includes a deck having a front portion and a rear portion, said front portion being selectively movable into a position atop said rear portion.

6. The system of claim 5 wherein said front portion is hingedly secured to said rear portion.

7. The system of claim 6 further including a removable deck assembly selectively positionable atop said team box deck, said removable deck including seating.

* * * * *